US011788324B2

(12) United States Patent
Ooyama et al.

(10) Patent No.: US 11,788,324 B2
(45) Date of Patent: Oct. 17, 2023

(54) OUTER HANDLE DEVICE FOR VEHICLE DOOR

(71) Applicant: KABUSHIKI KAISHA HONDA LOCK, Miyazaki (JP)

(72) Inventors: Tatsuya Ooyama, Miyazaki (JP); Yasuhiro Saitou, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 421 days.

(21) Appl. No.: 16/421,928

(22) Filed: May 24, 2019

(65) Prior Publication Data

US 2020/0190867 A1 Jun. 18, 2020

(30) Foreign Application Priority Data

Dec. 14, 2018 (JP) ..... 2018-234108

(51) Int. Cl.
*E05B 79/06* (2014.01)
*E05B 85/16* (2014.01)

(52) U.S. Cl.
CPC ..... *E05B 79/06* (2013.01); *E05B 85/16* (2013.01)

(58) Field of Classification Search
CPC ..... E05B 79/06; E05B 85/16; Y10T 292/57; Y10S 292/53
See application file for complete search history.

(56) References Cited

U.S. PATENT DOCUMENTS 6,363,577 B1 4/2002 Spitzley
6,543,090 B2 * 4/2003 Muneta ..... E05B 79/06 292/336.3
7,029,054 B2 * 4/2006 Kobayashi ..... E05B 79/06 296/146.1

(Continued)

FOREIGN PATENT DOCUMENTS

JP 5153742 B2 2/2013
JP 2014-224425 A 12/2014

OTHER PUBLICATIONS

Official Communication (International Search Report with Written Opinion) from a corresponding International Application, PCT/JP2019/011743, dated May 7, 2019.

*Primary Examiner* — Kristina R Fulton
*Assistant Examiner* — Noah Horowitz
(74) *Attorney, Agent, or Firm* — Carrier, Shende & Associates P.C.; Joseph P. Carrier; Fulchand P. Shende

(57) ABSTRACT

An outer handle device for a vehicle door includes: an outer handle having a supported portion on one end part thereof in a longitudinal direction; a support member having paired leg portions sandwiching the supported portion from opposite sides; and a base having paired support side walls sandwiching the leg portions from opposite sides. The supported portion is pivotably supported on the support member attached to the base by the leg portion engaging with the support side wall. A restriction device is provided between the supported portion and the support member, the restriction device restricting displacement of the support member toward a side on which engagement of the support member with the base is released at least when pulling the outer handle. Accordingly, it is possible to maintain a state in which the support member is attached to the base, even when the outer handle is forcibly pulled.

3 Claims, 11 Drawing Sheets

(56) References Cited

U.S. PATENT DOCUMENTS

| | | | | |
|---|---|---|---|---|
| 7,827,736 | B2 * | 11/2010 | Sunahara | E05B 85/16 49/503 |
| 8,757,686 | B2 * | 6/2014 | Ishida | E05B 85/16 292/357 |
| 8,777,281 | B2 | 7/2014 | Saitou | |
| 8,960,738 | B2 * | 2/2015 | Ishida | E05B 85/16 292/336.3 |
| 2018/0298650 | A1 * | 10/2018 | Ichikawa | E05B 85/16 |
| 2019/0234123 | A1 * | 8/2019 | Saitou | E05B 77/36 |
| 2021/0156173 | A1 * | 5/2021 | Ruse | E05B 79/06 |

* cited by examiner

OUTER HANDLE DEVICE FOR VEHICLE DOOR

CROSS REFERENCE TO RELATED APPLICATIONS

The present application claims priority under 35 U.S.C. § 119 to Japanese Patent Application No. 2018-234108 filed Dec. 14, 2018 the entire contents of which are hereby incorporated by reference.

BACKGROUND OF THE INVENTION

Field of the Invention

The present invention relates to an outer handle device for a vehicle door, comprising an outer handle that has a supported portion on one end part in a longitudinal direction of the outer handle and extends lengthwise in a vehicle fore-and-aft direction, a support member that has a pair of leg portions sandwiching the supported portion from opposite sides, and a base that has a pair of support side walls sandwiching the pair of leg portions from opposite sides and is mounted inside an outer panel of a door, the supported portion being pivotably supported on the support member attached to the base by the leg portion engaging with the support side wall.

Description of the Related Art

Such an outer handle device for a vehicle door is known in Japanese Patent No. 5153742.

A support member pivotably supporting a supported part of an outer handle is attached to a base by means of engagement with a pair of support side walls of the base, and in the arrangement disclosed in Japanese Patent No. 5153742 there is a possibility that, when the outer handle is forcibly pulled so as to pull it further than a typical operated position, a large force will act on a part where the support member engages with the support side wall of the base, a pair of leg parts of the support member will flex inward, and the engagement with the support side wall will be released.

SUMMARY OF THE INVENTION

The present invention has been accomplished in light of such circumstances, and it is an object thereof to provide an outer handle device for a vehicle door that enables a state in which a support member is attached to a base to be maintained even when an outer handle is forcibly pulled.

In order to achieve the object, according to a first aspect of the present invention, there is provided an outer handle device for a vehicle door, comprising an outer handle that has a supported portion on one end part in a longitudinal direction of the outer handle and extends lengthwise in a vehicle fore-and-aft direction, a support member that has a pair of leg portions sandwiching the supported portion from opposite sides, and a base that has a pair of support side walls sandwiching the pair of leg portions from opposite sides and is mounted inside an outer panel of a door, the supported portion being pivotably supported on the support member attached to the base by the leg portion engaging with the support side wall, wherein a restriction device is provided between the supported portion of the outer handle and the support member, the restriction device restricting displacement of the support member toward a side on which engagement of the support member with the base is released at least when pulling the outer handle.

In accordance with the first aspect of the present invention, since at least when the outer handle is pulled, displacement of the support member toward the side on which the engagement thereof with the base is released is restricted by virtue of the restriction device, even if a large force acts on the part where the support member and the base are engaged due to the outer handle being forcibly pulled, the state in which the support member is engaged with the base will not be released, thus maintaining a state in which the support member is attached to the base.

According to a second aspect of the present invention, in addition to the first aspect, the restriction device is formed from restricting projection parts that are projectingly provided respectively on the pair of leg portions of the support member and an interposing part that is provided on the supported portion so as to be present between the pair of restricting projection parts when the outer handle is pulled.

In accordance with the second aspect of the present invention, since the restriction device is formed from the pair of restricting projection parts, which are projectingly provided on the leg portions of the support member, and the interposing part, which is provided on the supported part so as to be present between the pair of restricting projection parts when the outer handle is pulled, and the restriction device exhibits its function only when the outer handle is pulled, the restriction device will not interfere with attachment of the outer handle to the base via the support member or maintenance thereof, and attachment and detachment of the outer handle can easily be carried out.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention is explained below by reference to the attached drawings.

Figure 1:
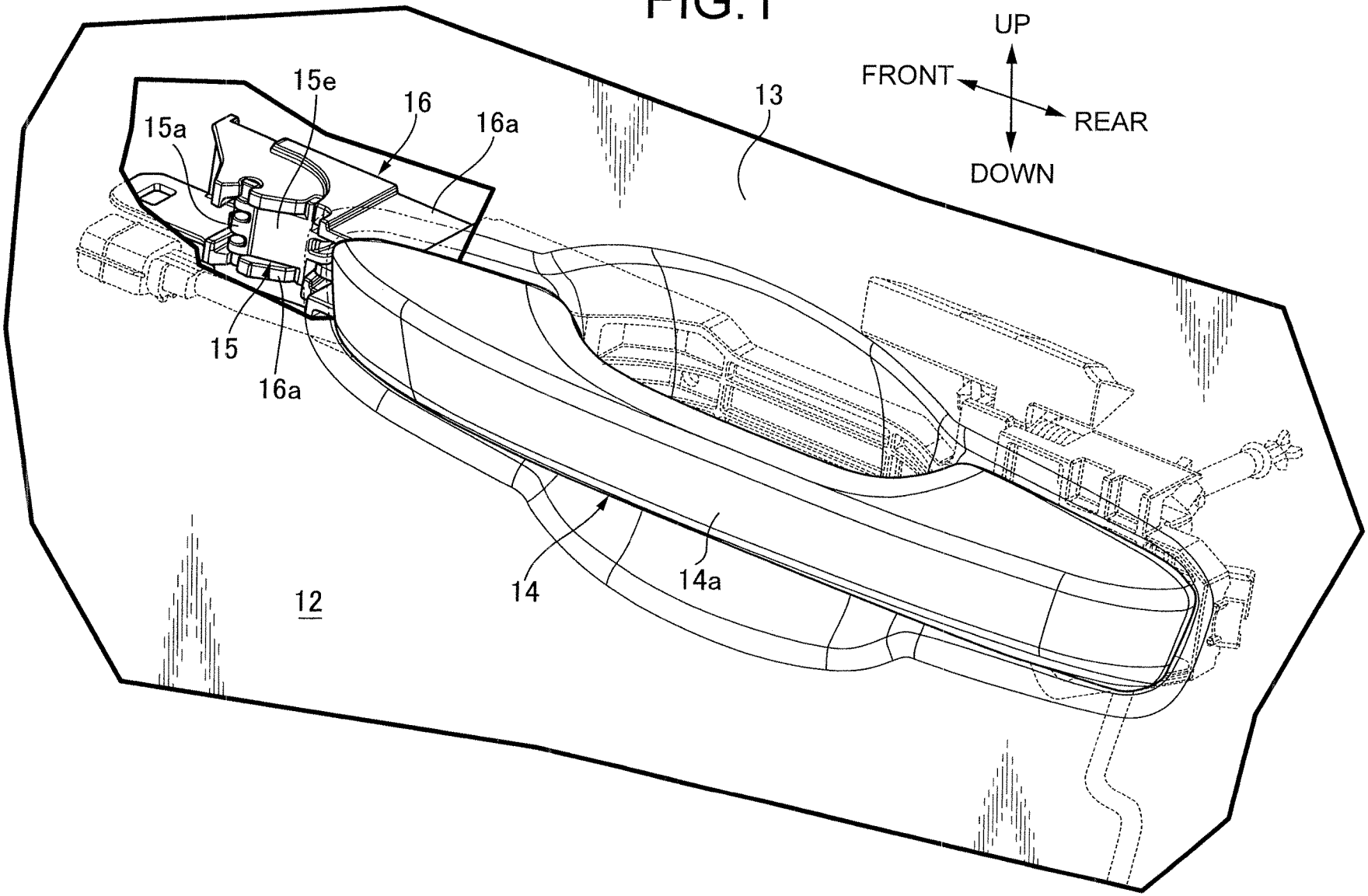
FIG. 1 is a partial perspective view of a vehicle door.
Figure 2:
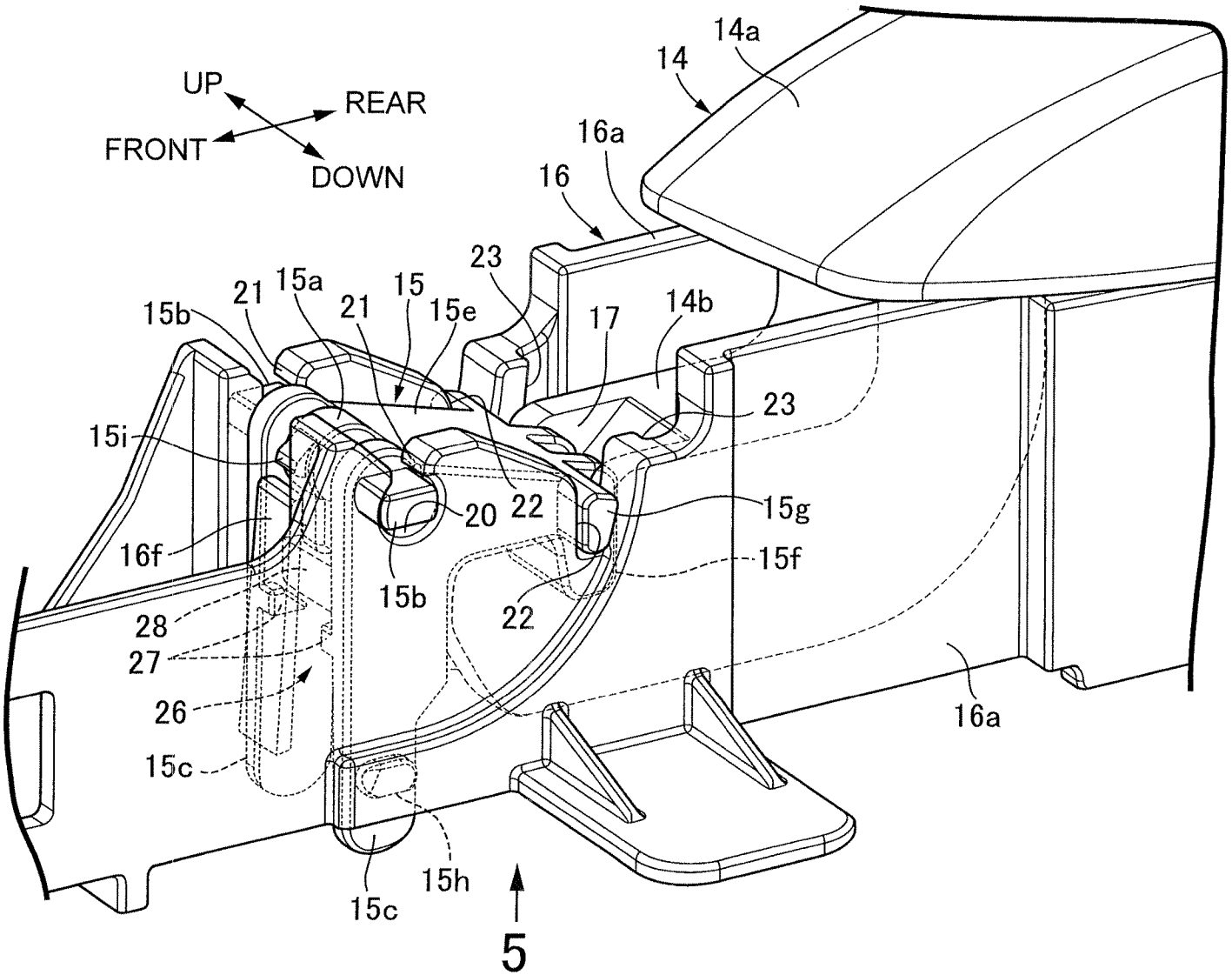
FIG. 2 is a perspective view showing a state in which an outer handle is supported on a base via a support member.

First, in FIG. 1 and FIG. 2, an outer handle device in accordance with the present invention is provided on an outer panel 13 of a vehicle door 12, which is a side door of a passenger vehicle; this outer handle device includes an outer handle 14 that extends lengthwise in the vehicle fore-and-aft direction, a support member 15 that pivotably supports the outer handle 14, and a base 16 that is mounted inside the outer panel 13, the support member 15 being attached to the base 16.

Figure 3:
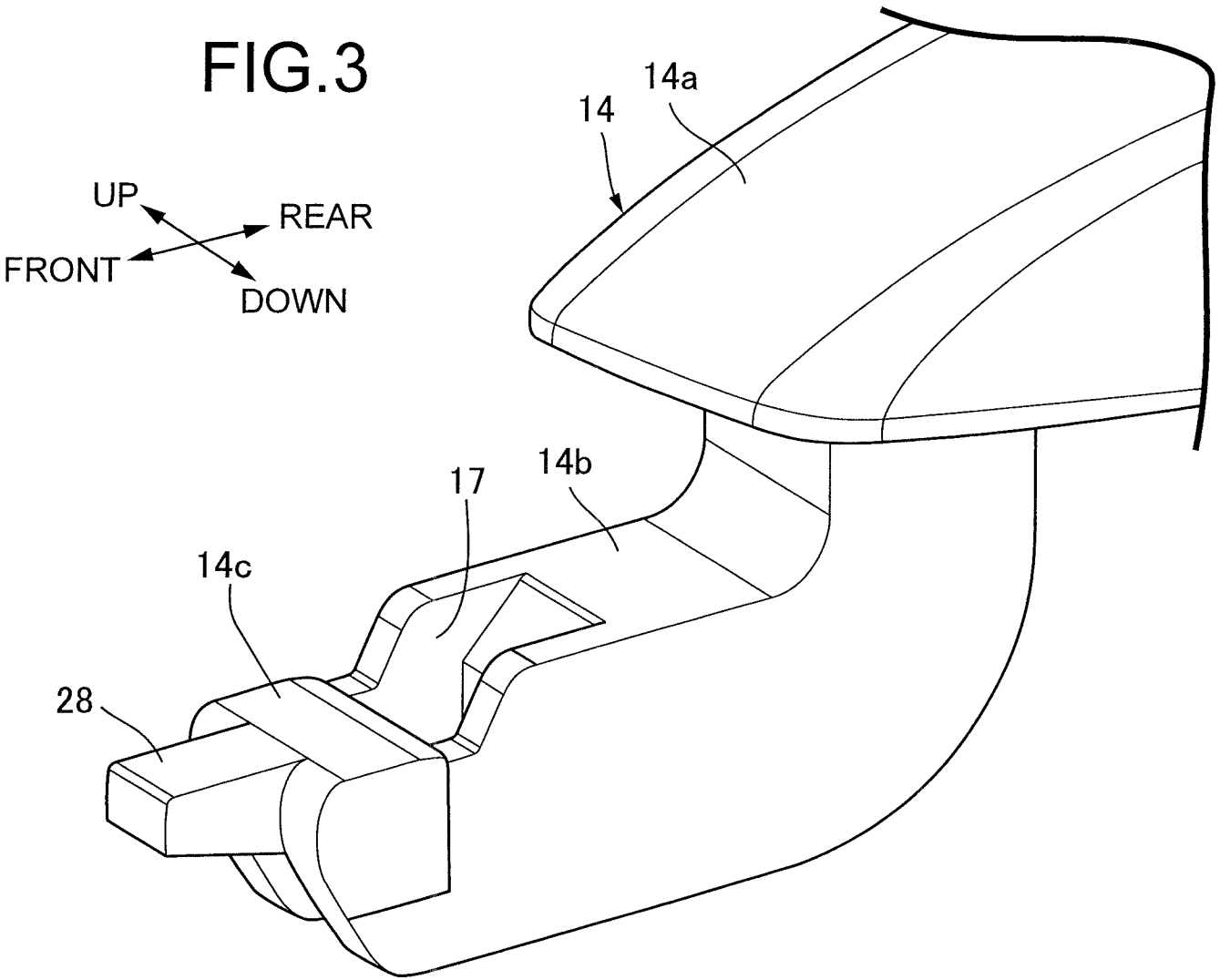
FIG. 3 is a perspective view of an essential part of the outer handle.

Referring in addition to FIG. 3, the outer handle 14 is formed from a synthetic resin so as to have an operating portion 14*a* that is disposed outside the outer panel 13 and extends in the vehicle fore-and-aft direction and a support arm portion 14*b* that is connectedly provided on one end side, in the longitudinal direction, of the operation portion 14*a* and is bent into a substantially L shape, the support arm portion 14*b* penetrating into the outer panel 13.

A fitting hole 17 is provided in an intermediate part close to the extremity of the support arm portion 14*b*, and an end part, further on the extremity side than the fitting hole 17, of the support arm portion 14*b* is formed as a supported portion 14*c* that is pivotably supported on the support member 15. That is, the outer handle 14 is formed so as to have the supported portion 14*c* on one end part in the longitudinal direction.

Figure 4:
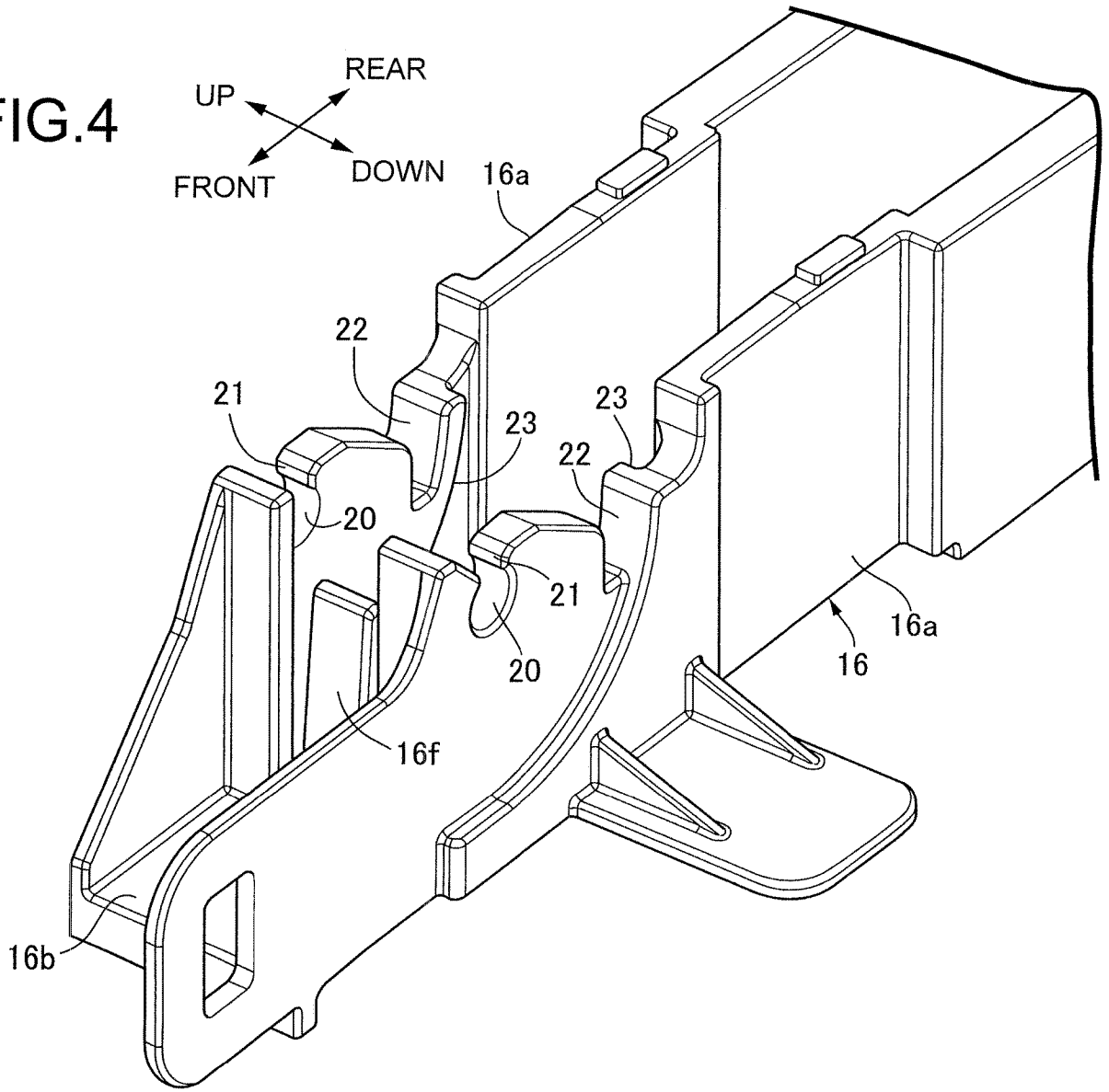
FIG. 4 is a perspective view of an essential part of the base.
Figure 5:
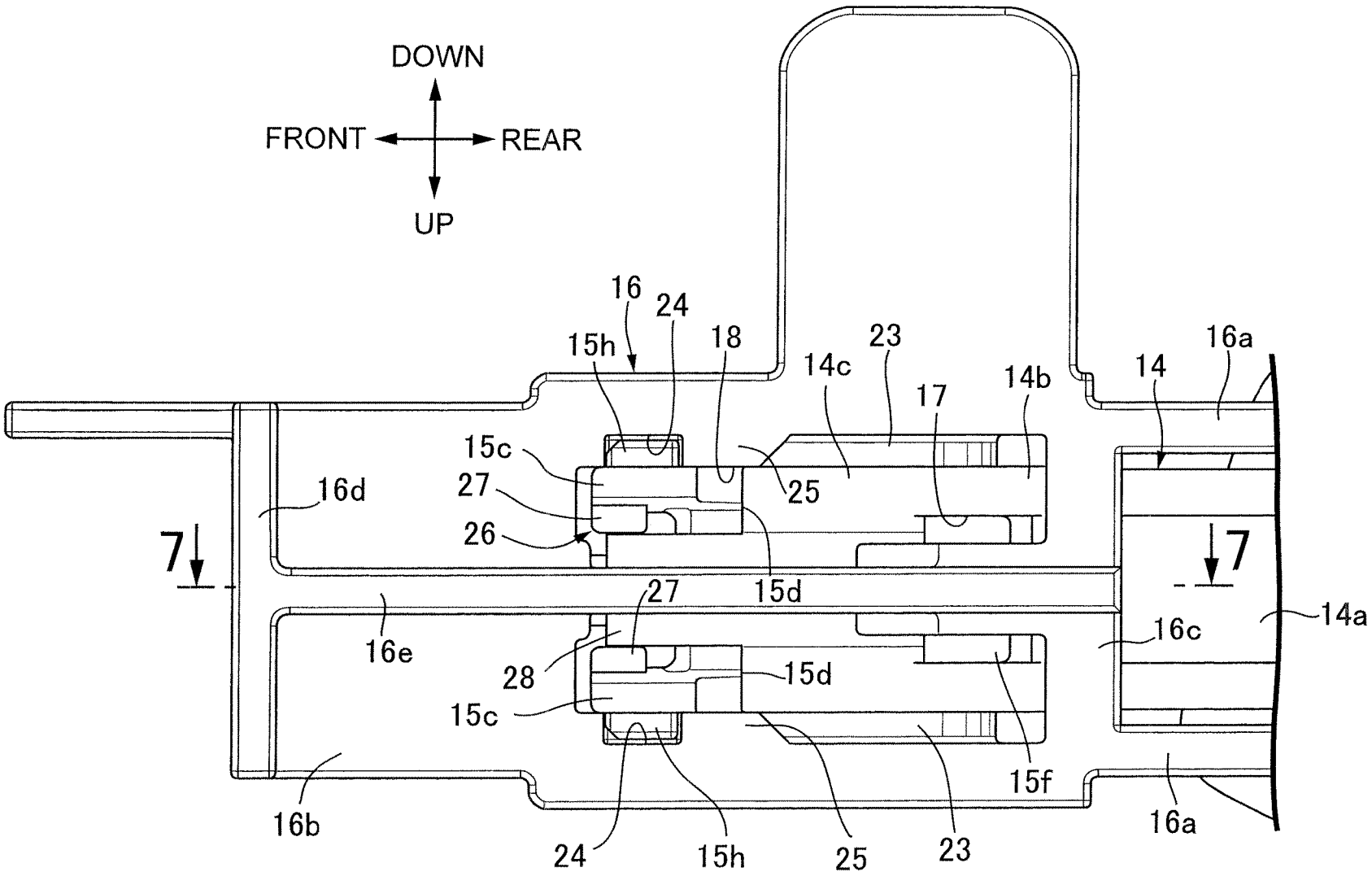
FIG. 5 is a view in the direction of arrow 5 in FIG. 2.

Referring in addition to FIG. 4 and FIG. 5, the base 16 integrally has a pair of support side walls 16*a* that sandwich from opposite sides the support arm portion 14*b*, including the supported portion 14*c*, and extend along the longitudinal direction of the outer handle 14, a first linking wall 16*b* that provides a link between end parts, on the side opposite to the outer panel 13, of front end parts of the pair of support side walls 16*a* in the vehicle fore-and-aft direction, and a second linking wall 16*c* that provides a link between end parts, on the side opposite to the outer panel 13, of the pair of support side walls 16*a* at a position spaced rearward from the first linking wall 16*b*, a rectangular opening 18 being formed from the first and second linking walls 16*b* and 16*c* and the pair of support side walls 16*a*.

A first reinforcing wall 16*d* is provided integrally with a front end part of the first linking wall 16*b* so as to project toward the side opposite to the outer panel 13, and a second reinforcing wall 16*e* providing a connection between the first linking wall 16*b* and the second linking wall 16*c* while straddling the opening 18 is connectedly provided integrally with the first and second linking walls 16*b* and 16*c* while being connected to a middle part of the first reinforcing wall 16*d* so as to have a substantially T-shaped form, the second reinforcing wall 16*e* projecting from the linking walls 16*b* and 16*c* toward the side opposite to the outer panel 13 via a portion corresponding to the first and second linking walls 16*b* and 16*c*.

A base end part of an elastic wall 16*f* is connectedly provided integrally with a rear end part of the first linking wall 16*b* in the vehicle fore-and-aft direction, the elastic wall 16*f* following a plane orthogonal to the longitudinal direction of the pair of support side walls 16*a* and being disposed in a middle part between the support side walls 16*a*, and the elastic wall 16*f* extending from the first linking wall 16*b* toward the side close to the outer panel 13 in a state in which the base 16 is mounted on the outer panel 13.

Figure 6:
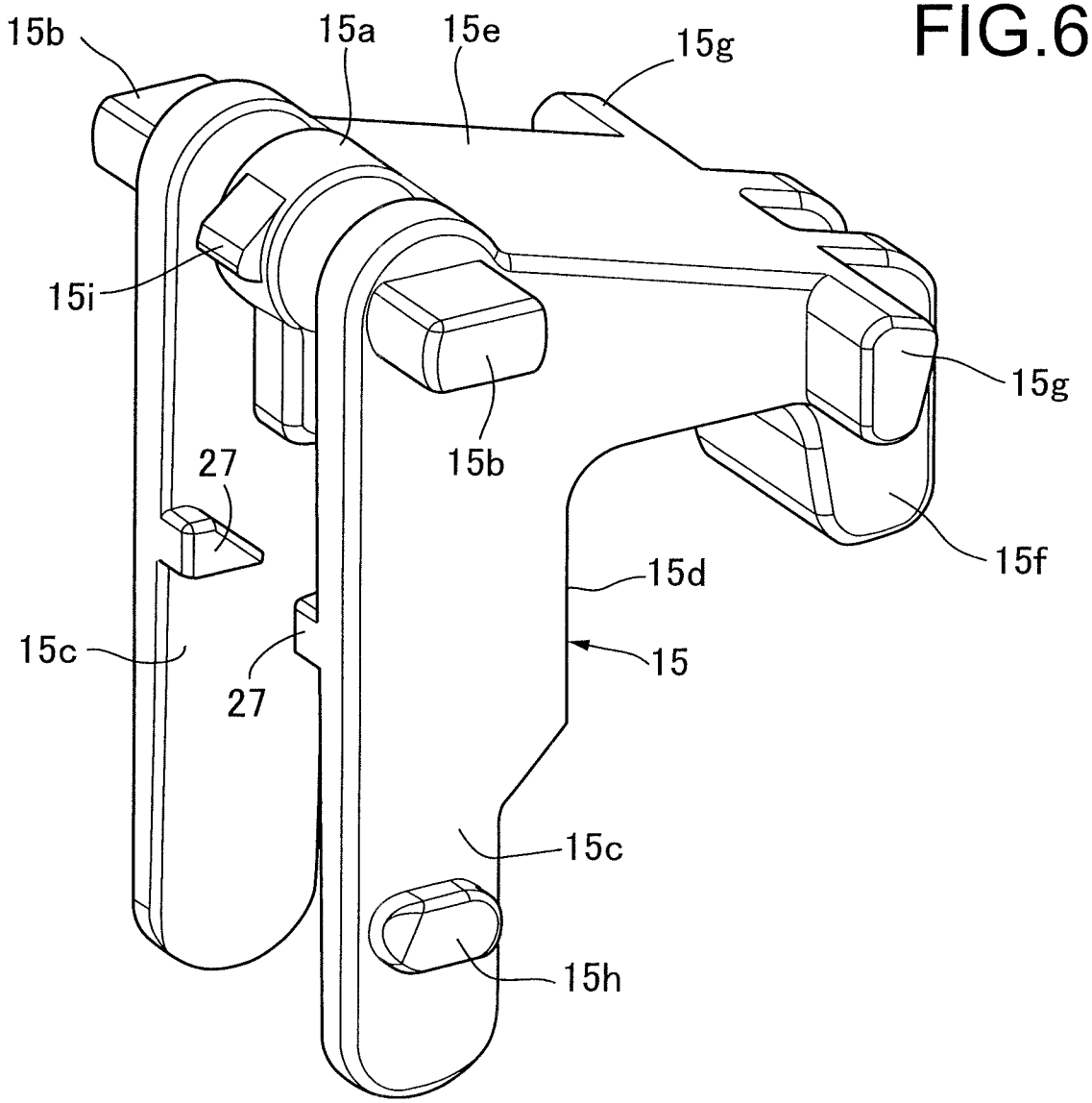
FIG. 6 is a perspective view of the support member.
Figure 7:
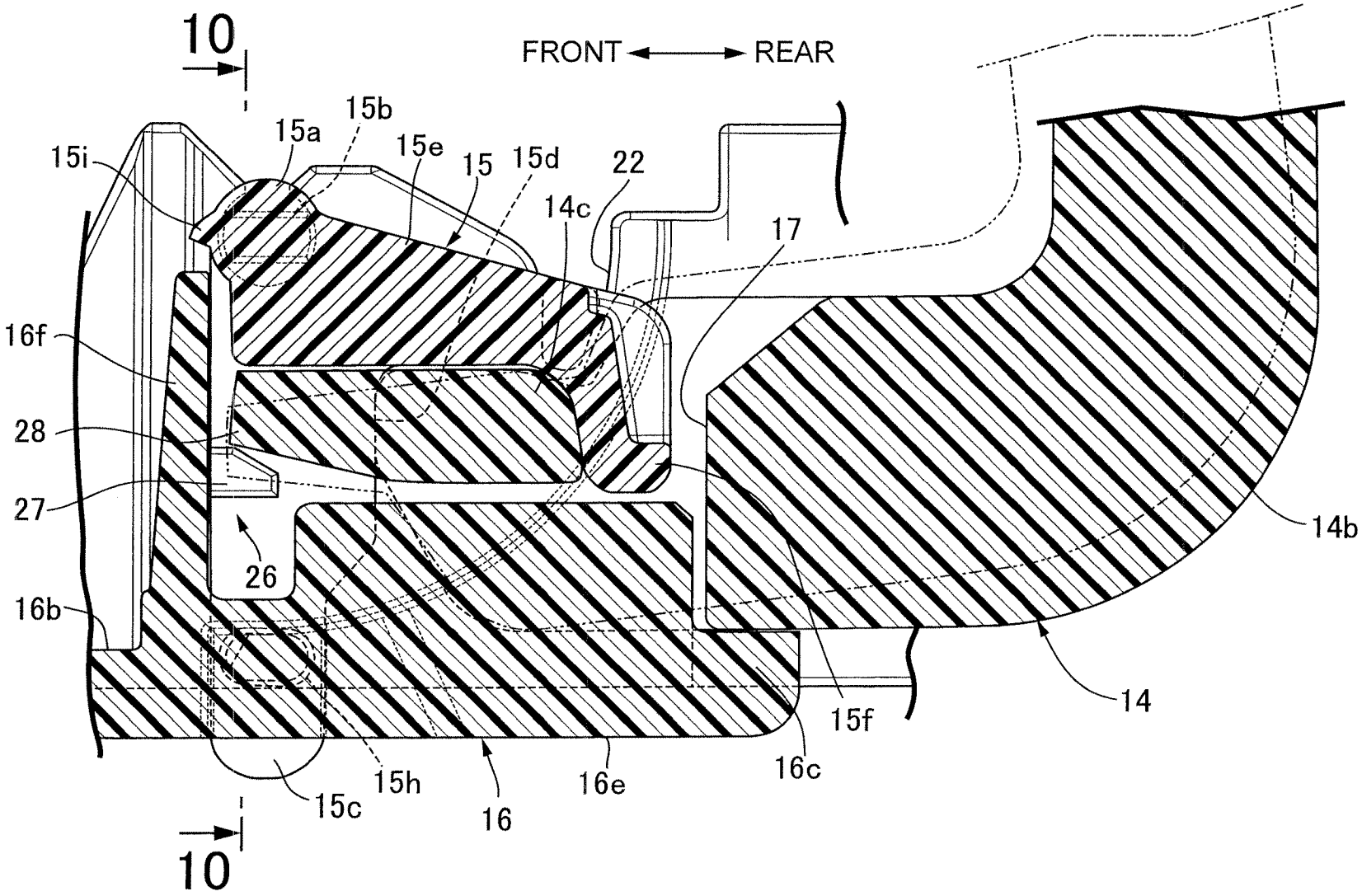
FIG. 7 is a sectional view along line 7-7 in FIG. 5.

Referring in addition to FIG. 6 and FIG. 7, the support member 15 integrally has a pivoting base portion 15*a* that is provided with a pair of support shafts 15*b* pivotably supported on the pair of support side walls 16*a* and projecting toward opposite sides, a pair of leg portions 15*c* that are disposed inside the two support side walls 16*a* with their base end parts connected to the pivoting base portion 15*a* while their extremities can flex so as to move toward each other, an abutment receiving portion 15*d* that is formed on an intermediate part of the two leg portions 15*c* so as to project rearward along the vehicle fore-and-aft direction while enabling one end of the support arm portion 14*b* of the outer handle 14, that is, the supported portion 14*c*, to be abutted thereagainst, a linking arm portion 15*e* that extends from the pivoting base portion 15*a* rearward along the vehicle fore-and-aft direction while being substantially orthogonal to the extending direction of the leg portion 15*c* and being connected to the abutment receiving portion 15*d*, a fitting portion 15*f* that is fitted into the fitting hole 17 of the support arm portion 14*b* of the outer handle 14 and is connected to the extremity of the linking arm portion 15*e* so as to clasp the supported portion 14*c* between itself and the abutment receiving portion 15*d*, a pair of first engagement projection portions 15*g* that project from the extremity of the linking arm portion 15*e* toward the support side wall 16*a* side of the base 16, a second engagement projection portion 15*h* that projects from an intermediate part close to the extremity of each of the leg portions 15*c* toward the support side wall 16*a* side of the base 16, and an attitude-maintaining projecting portion 15*i* that projects from the pivoting base portion 15*a* forward along the vehicle fore-and-aft direction.

A support hole 20 and an entry path 21 are formed in an end part, on the outer panel 13 side, of a front part of the support side wall 16*a* in a state in which the base 16 is mounted on the outer panel 13, the entry path 21 being connected to the support hole 20 and opening on the outer panel 13 side, and a first latching recess 22 is formed in an end part, on the outer panel 13 side, of the support side wall 16*a* to the rear of the support hole 20 and the entry path 21.

Figure 8:
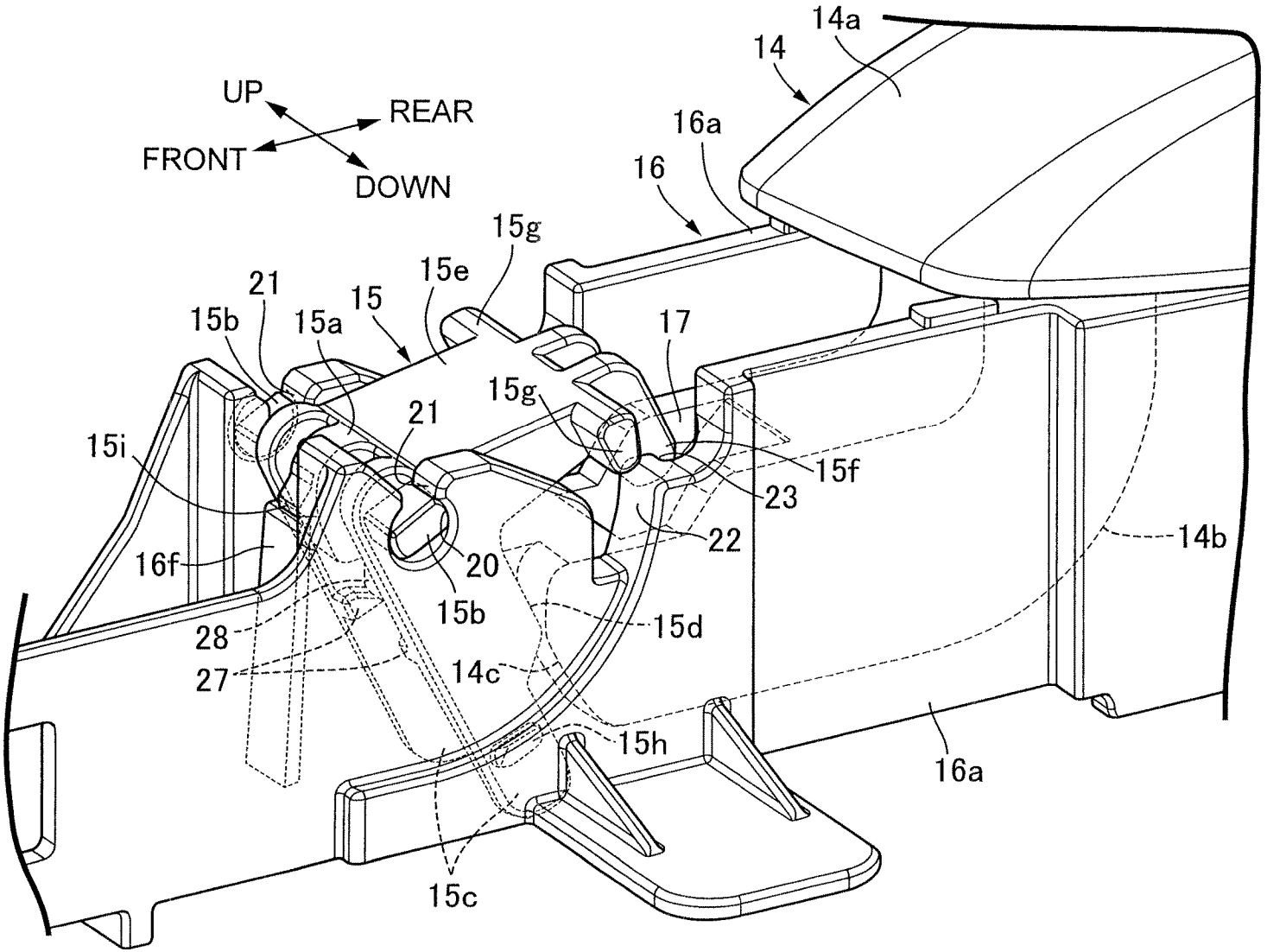
FIG. 8 is a perspective view, corresponding to FIG. 2, in a state in which the support member is at a pre-attachment holding position.
Figure 9:
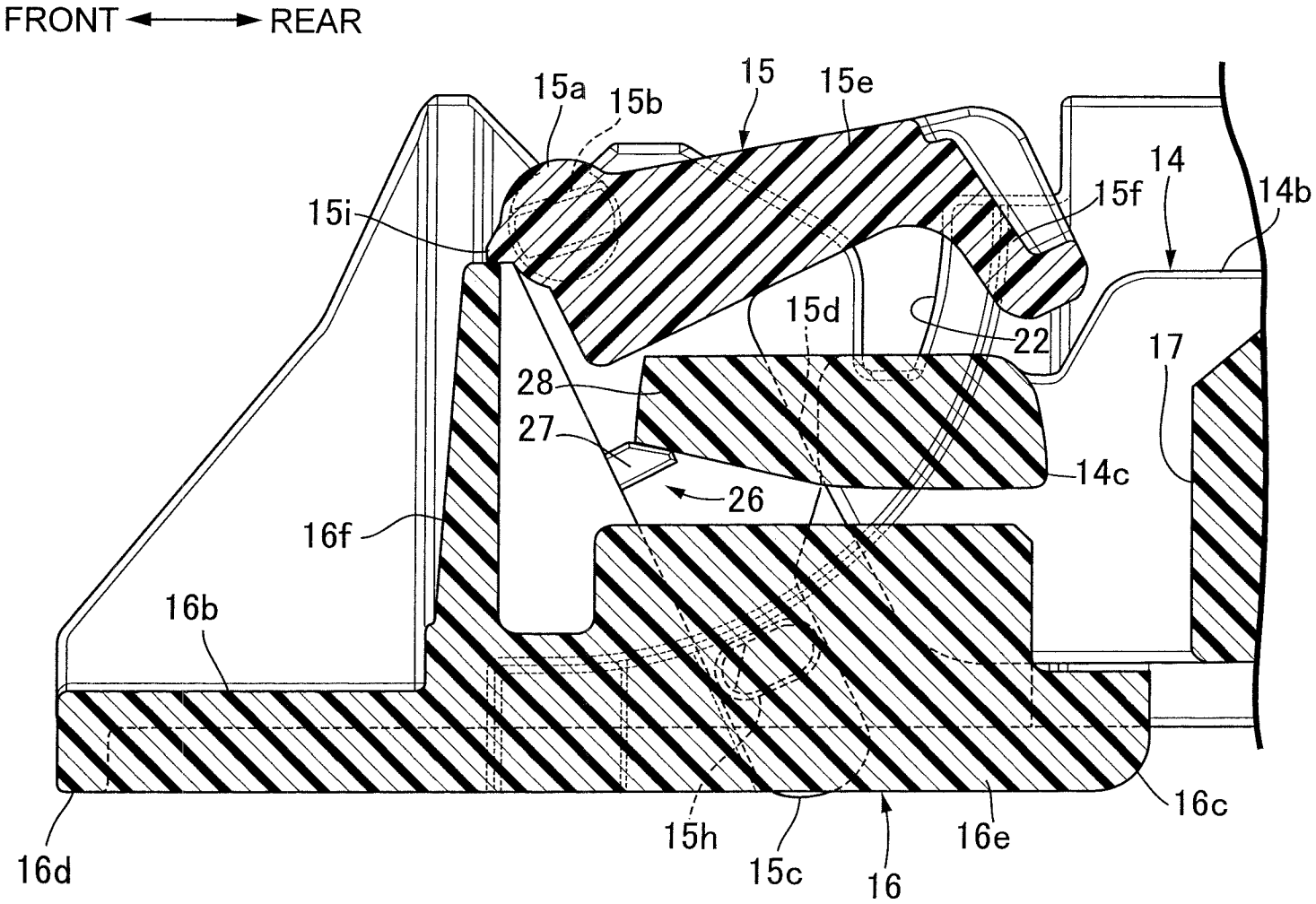
FIG. 9 is a sectional view, corresponding to FIG. 7, in a state in which the support member is at the pre-attachment holding position.

The support member 15 is supported on the support side wall 16*a* of the base 16 so that it can pivot between a pre-attachment holding position shown in FIG. 8 and FIG. 9 and an attachment completion position shown in FIG. 2, FIG. 5, and FIG. 7. The support member 15 is inserted between the pair of support side walls 16*a* so that the support shaft 15*b* of the support member 15 is fitted into the support hole 20 via the entry path 21, and the attitude of the support member 15 can be changed so that the support shaft 15*b* is pivoted within the support hole 20. In this process, a guide step 23 for guiding movement of the second engagement projection portion 15*h* of the support member 15 is formed on an inner face of the support side wall 16*a* so as to extend in an arc shape along an imaginary circle with the center of the support hole 20 as a center.

When the support member 15 is inserted between the support side walls 16*a*, the attitude-maintaining projecting portion 15*i* makes contact with the extremity of the elastic wall 16*f*, and the resilient force of the elastic wall 16*f* acts on the support member 15 toward the side that prevents pivoting thereof; applying an external force that exceeds the resilient force to the support member 15 pivots the support member 15 while flexing the elastic wall 16*f*, and as shown in FIG. 9 due to the attitude-maintaining projecting portion 15*i* riding over the elastic wall 16*f*, the support member 15 is retained at the pre-attachment holding position.

In a state in which the support member 15 is present at the pre-attachment holding position, the support arm portion 14*b* of the outer handle 14 is inserted between the pair of support side walls 16*a* of the base 16, the extremity of the support arm portion 14*b* is abutted against the abutment receiving portion 15*d* of the support member 15, and the outer handle 14 is pressed forward in the vehicle fore-and-aft direction, thus pivoting the support member 15 from the pre-attachment holding position to the attachment completion position. In order to hold the attachment completion position, a second latching recess 24 and a latching claw part 25 are formed on an inner face of a portion, corresponding to a front end part of the opening 18, of each of the pair of support side walls 16*a* of the base 16, the latching claw part 25 being disposed between the guide step 23 and the second latching recess 24. When pivoting from the pre-attachment holding position to the attachment completion position, the second engagement projection portion 15*h* rides over the latching claw part 25 while flexing the pair of leg portions 15*c*, which have the engagement projecting portion 15*h* provided thereon, toward the side on which they move toward each other, and resiliently engages with the second latching recess 24. At the attachment completion position the first engagement projection portion 15*g* of the support member 15 engages with the first latching recess 22 of the support side wall 16*a*, and with the engagement of the first engagement projection portion 15*g* with the first latching recess 22 and the engagement of the second engagement projection portion 15*h* with the second latching recess 24, positioning and mounting of the support member 15 on the base 16 is completed, the support member 15 pivotably clasping the supported portion 14*c* of the outer handle 14.

When pulling the outer handle 14 from a non-operated state, the outer handle 14 pivots to the position shown by a chain line in FIG. 7, and the support member 15 experiences a force in a direction in which it disengages from between the pair of support side walls 16*a* of the base 16. Forcibly pulling the outer handle 14 applies a large force to a part of the support member 15 engaged with the support side wall 16*a* of the base 16, that is, a part of the second engagement projection portion 15*h* engaged with the second latching recess 24, the pair of leg portions 15*c* of the support member 15 flex inward, and there is a possibility that the engagement with the support side wall 16*a* will be released.

In accordance with the present invention, restriction means 26 is provided between the supported portion 14*c* of the outer handle 14 and the support member 15, the restriction means 26 restricting displacement of the support member 15 toward the side on which engagement with the base 16 is released at least when the outer handle 14 is pulled.

Figure 10:
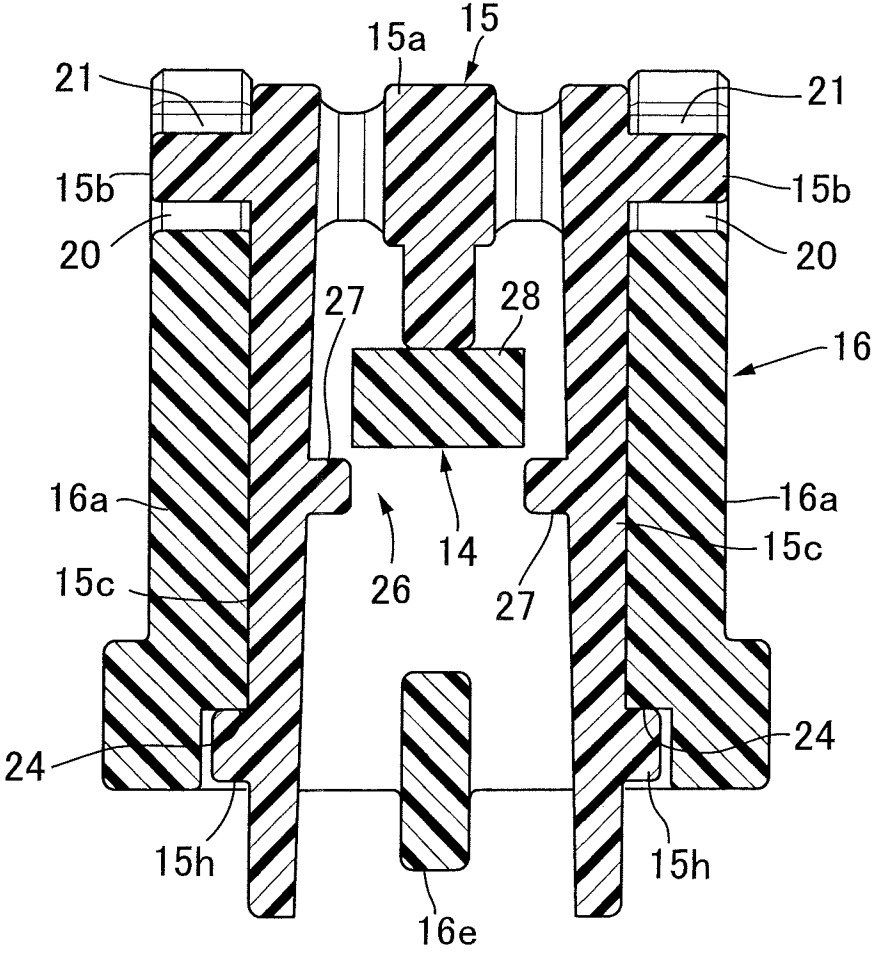
FIG. 10 is a sectional view along line 10-10 in FIG. 7.

In FIG. 10, the restriction means 26 in this embodiment exhibits its function when the outer handle 14 is pulled, the restriction means 26 being formed from a restricting projection part 27 that is projectingly provided on each of the pair of leg portions 15*c* of the support member 15 and an interposing part 28 that is provided on the supported portion 14*c* so as to be present between a pair of the restricting projection parts 27 when the outer handle 14 is pulled.

The restricting projection parts 27 are projectingly provided integrally with the leg portions 15*c* so as to project from mutually opposing faces of the leg portions 15*c* of the support member 15 toward the side on which the restricting projection parts 27 are closer to each other. The interposing part 28 is projectingly provided integrally with the supported portion 14*c* of the outer handle 14 so as to project from the supported portion 14*c* forward in the vehicle fore-and-aft direction.

Figure 11:
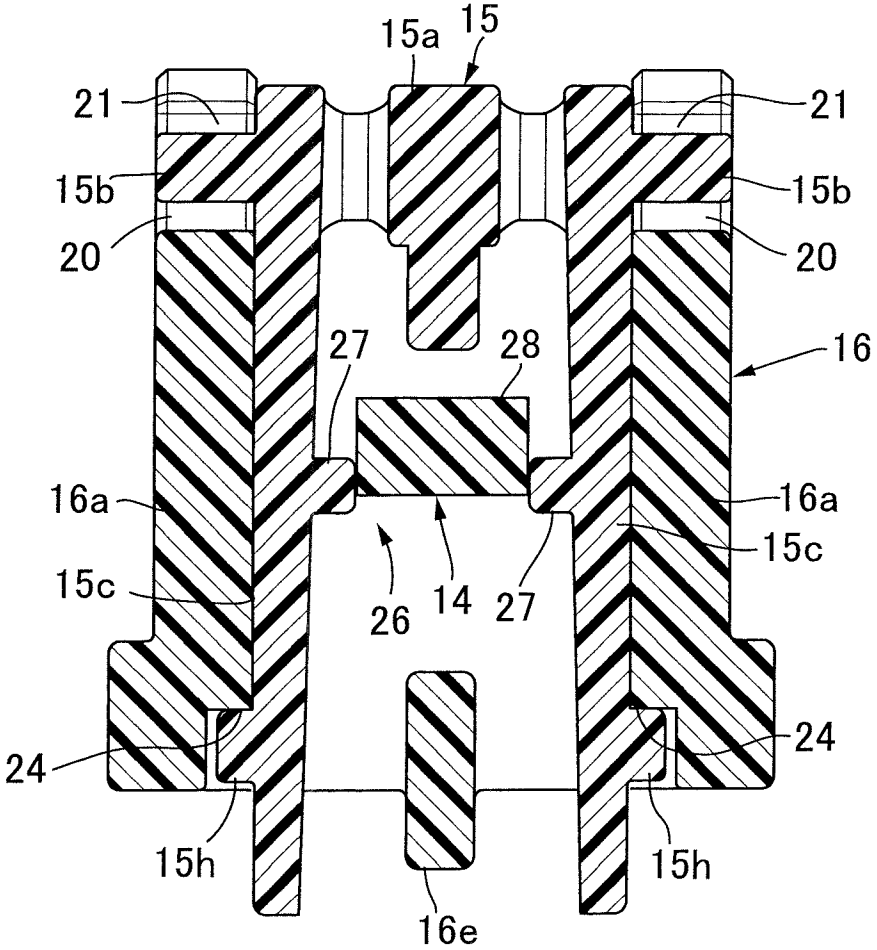
FIG. 11 is a sectional view, corresponding to FIG. 10, when the outer handle is pulled.

In the restriction means 26, when the outer handle 14 is in a non-operated state, as shown in FIG. 10, the interposing part 28 is not present between the pair of restricting projection parts 27, and as shown in FIG. 11 when the outer handle 14 is pulled from the non-operated state, the interposing part 28 is present between the pair of restricting projection parts 27 and restricts displacement of the support member 15 toward the side on which the engagement thereof with the base 16 is released, that is, restricts flexing of the pair of leg portions 15*c* of the support member 15 so that they move toward each other.

The operation of the embodiment is now explained; since the restriction means 26, which restricts displacement of the support member 15 toward the side on which the engagement thereof with the base 16 is released at least when the outer handle 14 is pulled, is provided between the supported portion 14*c* of the outer handle 14 and the support member 15, at least when the outer handle 14 is pulled, even if a large force acts on the engagement parts of the support member 15 and the base 16 due to the outer handle 14 being forcibly pulled, the state in which the support member 15 is engaged with the base 16 will not be released, thus maintaining a state in which the support member 15 is attached to the base 16.

Furthermore, since the restriction means 26 is formed from the restricting projection part 27, which is projectingly provided on each of the pair of leg portions 15*c* of the support member 15, and the interposing part 28, which is provided on the supported portion 14*c* so as to be present between the pair of restricting projection parts 27 when the outer handle 14 is pulled, the restriction means 26 exhibits its function only when the outer handle 14 is pulled, the restriction means 26 will not interfere with attachment of the outer handle 14 to the base 16 via the support member 15 or maintenance thereof, and attachment and detachment of the outer handle 14 can easily be carried out.

An embodiment of the present invention is explained above, but the present invention is not limited to the above-mentioned embodiment and may be modified in a variety of ways as long as the modifications do not depart from the gist of the present invention.

What is claimed is:

1. An outer handle device for a vehicle door, comprising an outer handle that has a supported portion on one end part in a longitudinal direction of the outer handle and extends lengthwise in a vehicle fore-and-aft direction;

a support member that has a pair of leg portions sandwiching the supported portion from opposite sides; and a base that has a pair of support side walls sandwiching the pair of leg portions from opposite sides and is mounted inside an outer panel of a door, wherein the supported portion is pivotably supported on the support member attached to the base by engagement projection portions of the leg portions engaging with latching recesses of the support side walls, a restriction device is provided between the supported portion and the support member, the restriction device restricting displacement of the support member toward a side on which engagement of the support member with the base is released at least when pulling the outer handle, the restriction device includes an interposing part provided with and projecting from the supported portion at the one end part of the outer handle and restricting projecting parts provided on the pair of leg portions of the support member, the restricting projecting parts are structured to engage the interposing part when the outer handle is pulled, and the restricting projecting parts do not engage the interposing part when the outer handle is not pulled.

2. The outer handle device for a vehicle door according to claim 1, wherein the interposing part extends in the lengthwise direction of the outer handle.

3. The outer handle device according to claim 1, wherein the restriction device is configured to restrict the displacement of the support member toward a side on which engagement of the support member with the base is released at least when pulling the outer handle and after the outer handle device has been assembled on the vehicle.

* * * * *